US006772939B1

(12) United States Patent
Simpson

(10) Patent No.: US 6,772,939 B1
(45) Date of Patent: Aug. 10, 2004

(54) SAFETY MAILBOX

(76) Inventor: Steven T. Simpson, 5749 W. 41st St. South Circle, Wichita, KS (US) 67215

( * ) Notice: Subject to any disclaimer, the term of this patent is extended or adjusted under 35 U.S.C. 154(b) by 0 days.

(21) Appl. No.: 10/337,175

(22) Filed: Jan. 7, 2003

(51) Int. Cl.[7] ..... B65D 91/00
(52) U.S. Cl. ..... 232/38; 232/17
(58) Field of Search ..... 232/17, 38, 45; 340/569

(56) References Cited

U.S. PATENT DOCUMENTS 4,133,021 A * 1/1979 King et al. ..... 361/660
4,650,113 A 3/1987 Hunt
5,036,310 A * 7/1991 Russell ..... 340/569
5,148,974 A 9/1992 Clapper
5,632,441 A 5/1997 Toval
5,954,264 A * 9/1999 Keller ..... 232/17
D474,321 S * 5/2003 Colgate ..... D99/29

* cited by examiner

*Primary Examiner*—William L. Miller

(57) ABSTRACT

A safety mailbox includes a housing having a body portion with an opening therein. A door is attached to the body portion for selectively opening or closing the opening in the housing. The body portion has a plurality of louvers extending therethrough such that air may freely enter and leave the housing.

9 Claims, 5 Drawing Sheets

SAFETY MAILBOX

BACKGROUND OF THE INVENTION

1. Field of the Invention

The present invention relates to mail receptacles and more particularly pertains to a new mail receptacle that would protect users and mail carriers from terrorism when delivering mail to or retrieving it from mailboxes.

2. Description of the Prior Art

The use of mail receptacles is known in the prior art. U.S. Pat. No. 4,650,113 describes a mailbox having transparent panels such that its contents can be viewed from a considerable distance. Another type of mail receptacle is U.S. Pat. No. 5,148,974 describes a security mailbox with improved anti-tamper means. U.S. Pat. No. 5,632,441 describes an elevating mailbox that has an electric motor operated by a remote control.

While these devices fulfill their respective, particular objectives and requirements, the need remains for a device that will aid in eliminating the threat that terrorism poses to the delivery of mail.

SUMMARY OF THE INVENTION

The present invention meets the needs presented above by utilizing louvers and fans to provide improved air flow through the housing, metal detector assembly to detect bombs, and a remote door opening assembly to aid in the safe removal of explosives.

Another object of the present invention is to provide a new mail receptacle that would allow household residents and mail carriers to readily identify if a dangerous item had been placed inside a mailbox.

Still another object of the present invention is to provide a new mail receptacle that would greatly reduce the likelihood of a mail carrier or household resident being victimized by terrorism and injured when opening a mailbox or being infected with illness from contaminated mail.

To this end, the present invention generally comprises a housing having a body portion with an opening therein. A door is attached to the body portion for selectively opening or closing the opening in the housing. The body portion has a plurality of louvers extending therethrough such that air may freely enter and leave the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
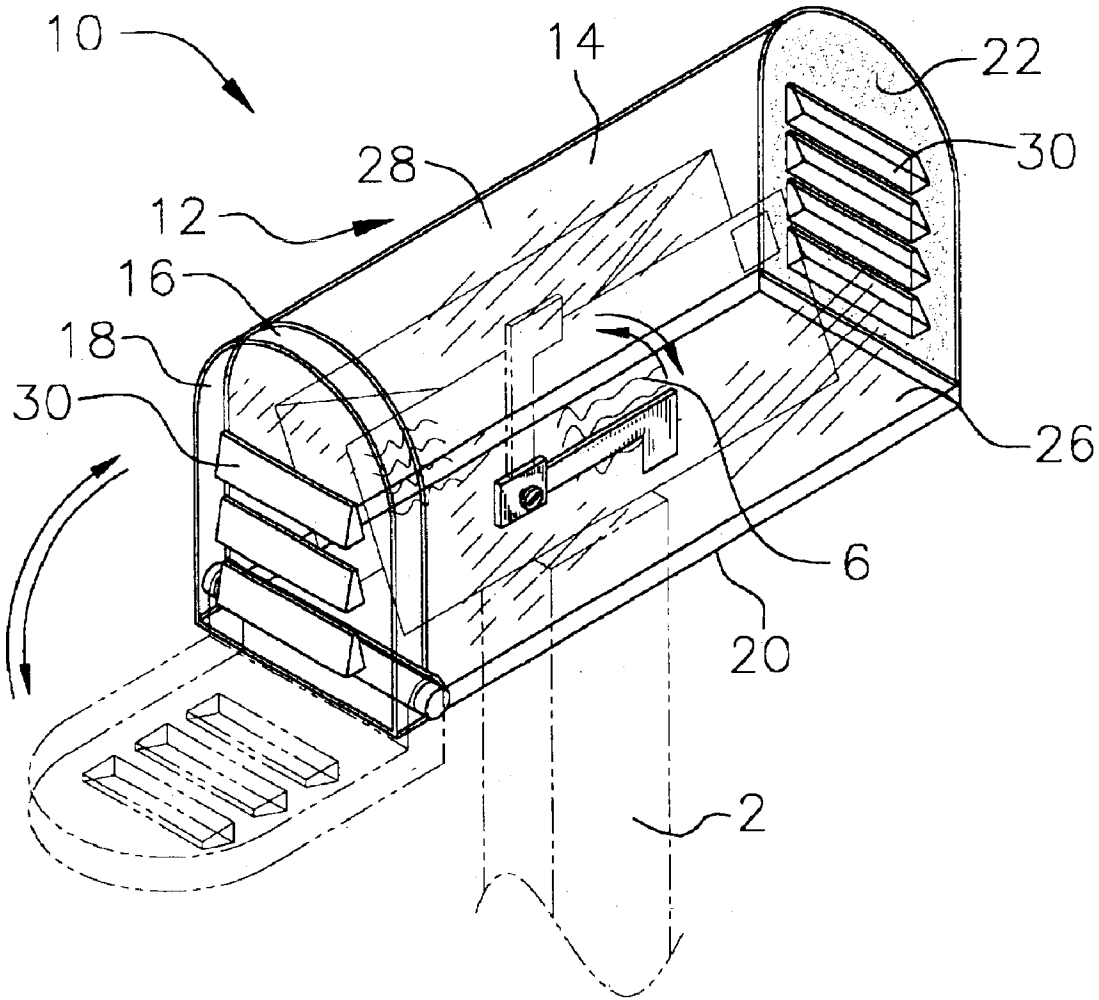
FIG. 1 is a schematic perspective view of a safety mailbox according to the present invention.
Figure 2:
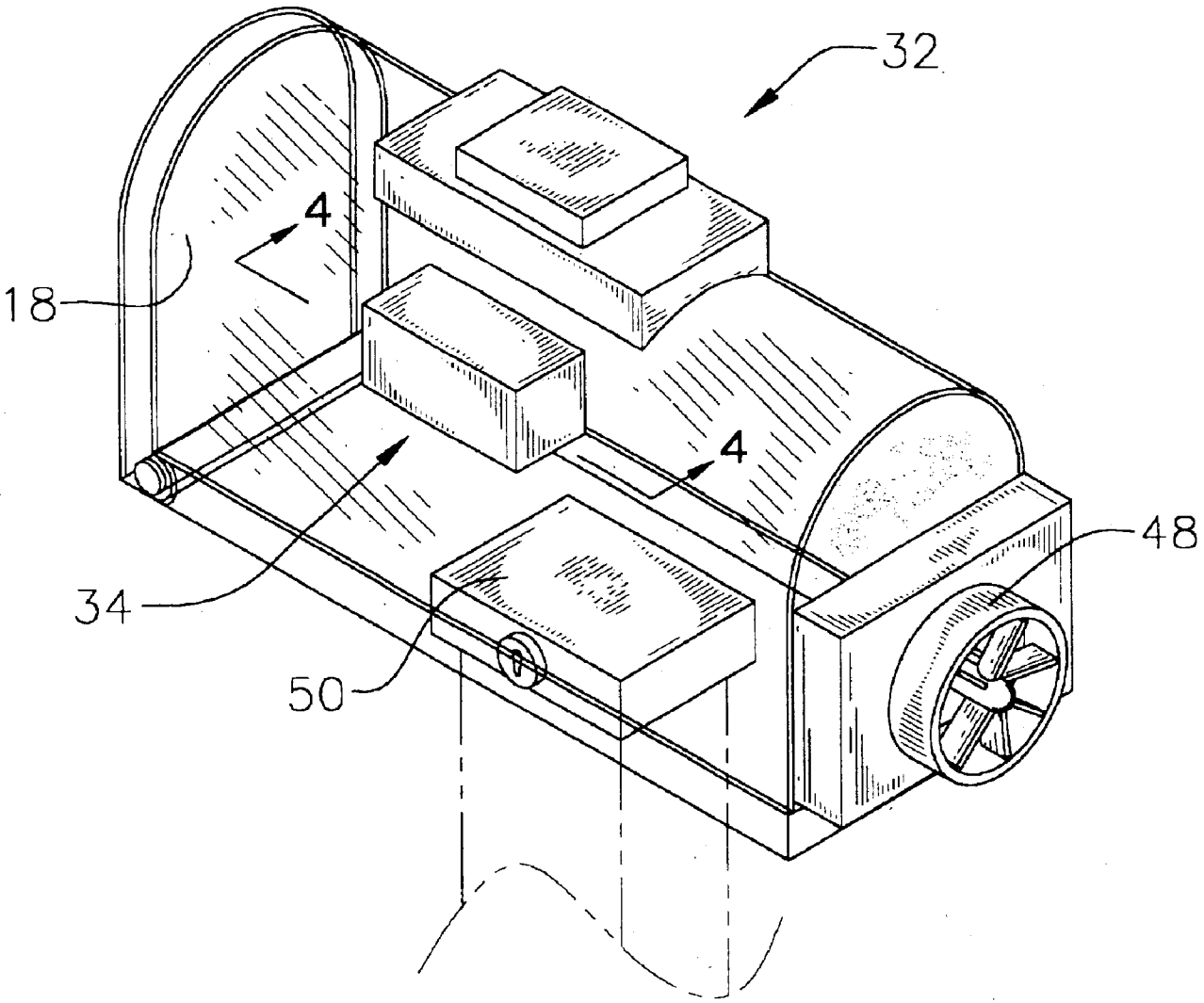
FIG. 2 is a schematic perspective view of the first embodiment of the present invention.
Figure 3:
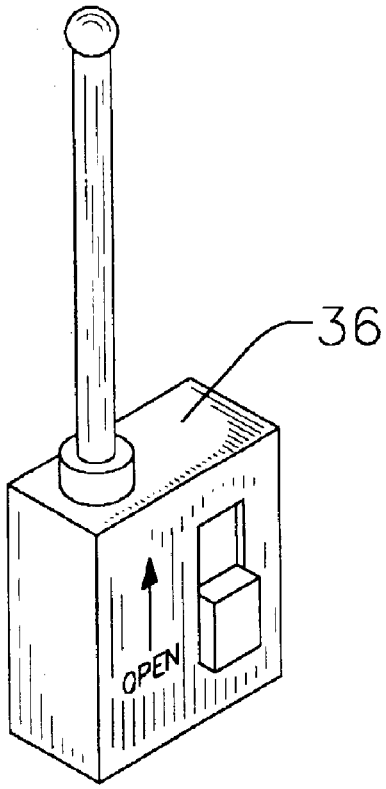
FIG. 3 is a schematic perspective view of a remote control of the present invention.
Figure 4:
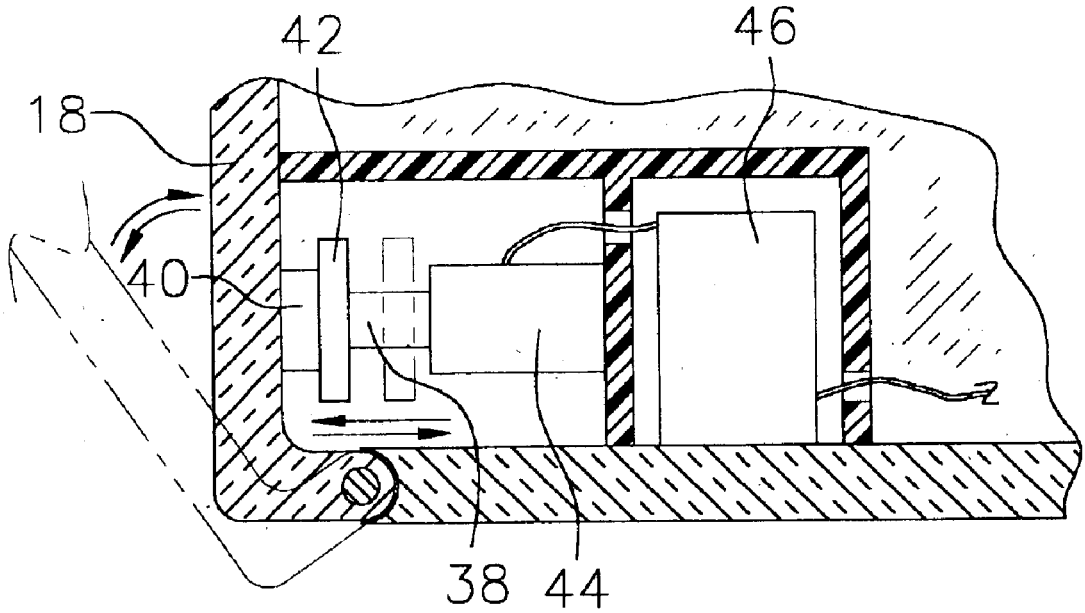
FIG. 4 is a schematic cross-sectional view taken along line 4—4 of the present invention.

With reference now to the drawings, and in particular to FIGS. 1 through 7 thereof, a new mail receptacle embodying the principles and concepts of the present invention and generally designated by the reference numeral 10 will be described.

As best illustrated in FIGS. 1 through 4 the first embodiment of the safety mailbox 10 generally comprises a housing 12 having a body portion 14 with an opening 16 therein. A door 18 is attached to the body portion 14 for selectively opening or closing the opening 16 in the housing 12. The body portion 14 includes a bottom wall 20, a back wall 22, a front wall 24, a pair of side walls 26 and a top wall 28. Each of the pair of side walls 26 and the top wall 28 is substantially transparent. The door 18 and back wall 22 may or may not be transparent. Each of the door 18 and the back wall 22 has a plurality of louvers 30 extending therethrough such that air may freely enter and leave the housing 12.

The first embodiment may also employ various mechanical features. These include a metal detecting assembly 32 that is mounted on the housing 12 and is adapted for detecting metal positioned in the housing 12. The metal detecting assembly 32 is conventional and preferably sounds an audible alarm when metal is positioned within the housing 12. A remotely controlled door opening assembly 34 is mounted in the housing 12. The door opening assembly 34 is selectively actuated by remote control 36. The door opening assembly 34 preferably employs magnet mounted on a piston 38. The door 18 has a metal plate 40 attached thereto that is secured to the magnet 42 when the piston 38 is in an extended position. The piston 38 is coupled to a motor 44 that retracts the piston 38 when a receiver 46 coupled to the motor 44 receives a signal from the remote control 36. The door 18 is biased toward an open position so that the door 18 swings open when magnet 42 is uncoupled from the metal plate 40. Optionally, a fan 18 may be coupled to the housing 12 for pulling air from the housing 12 if sufficient airflow does not extend through the housing 12. Additionally, a locking assembly 50 may be attached to the housing 12 for locking the housing 12 to a post 2.

Figure 5:
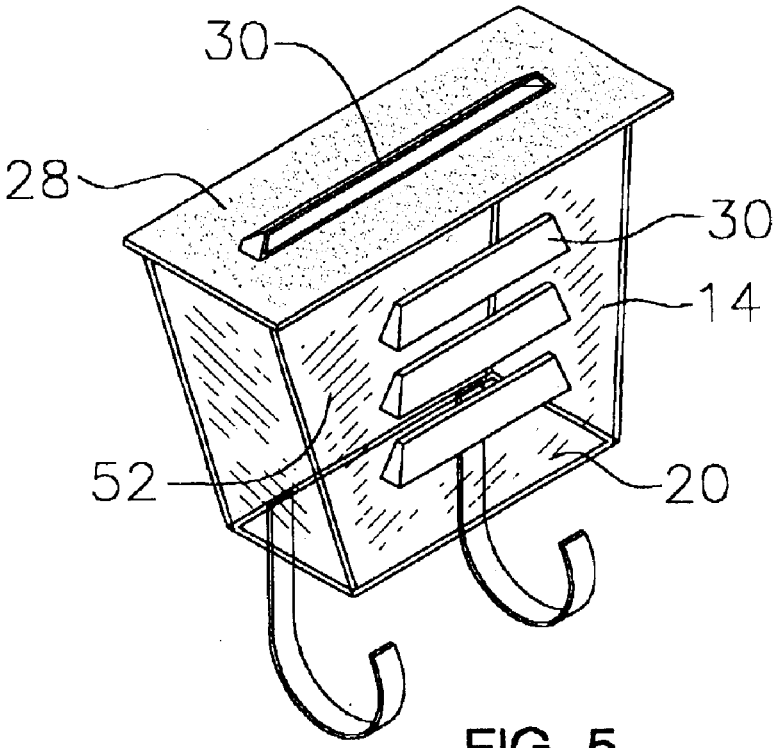
FIG. 5 is a schematic perspective view of a second embodiment of the present invention.

A second embodiment, depicted in FIG. 5, includes a body portion 14 having a bottom wall 20 and a peripheral wall 52 that is attached to and extends upwardly from the housing 12. In the second embodiment, the door 18 defines a top wall 28 of the housing 12. The louvers 30 are preferably positioned in the peripheral wall 52 and the top wall 28 and the peripheral wall 52 are each preferably transparent.

Figure 6:
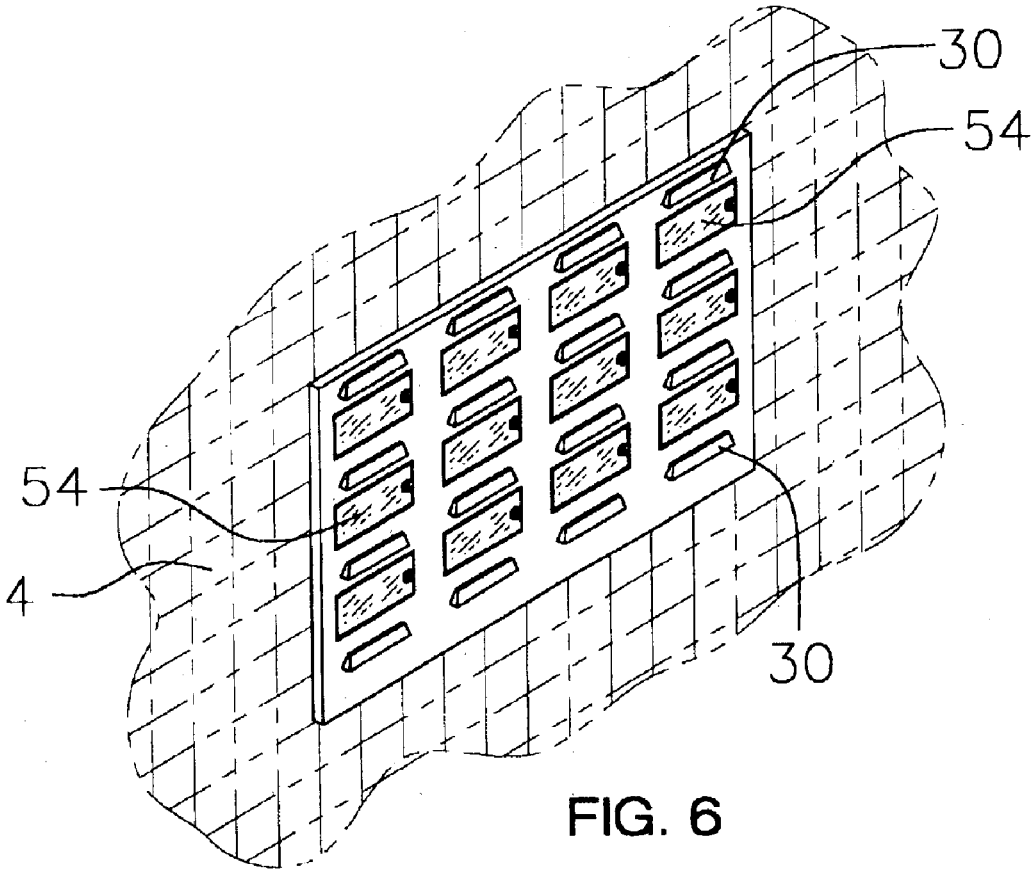
FIG. 6 is a schematic perspective view of a third embodiment of the present invention.

A third embodiment is shown in FIG. 6 and includes a conventional stacked arrangement of mailboxes 54 positioned in a wall 4. The mailboxes 54 of the third embodiment each have a transparent door 18. Each of a plurality of louvers 30 extends into one of the mailboxes 54.

Figure 7:
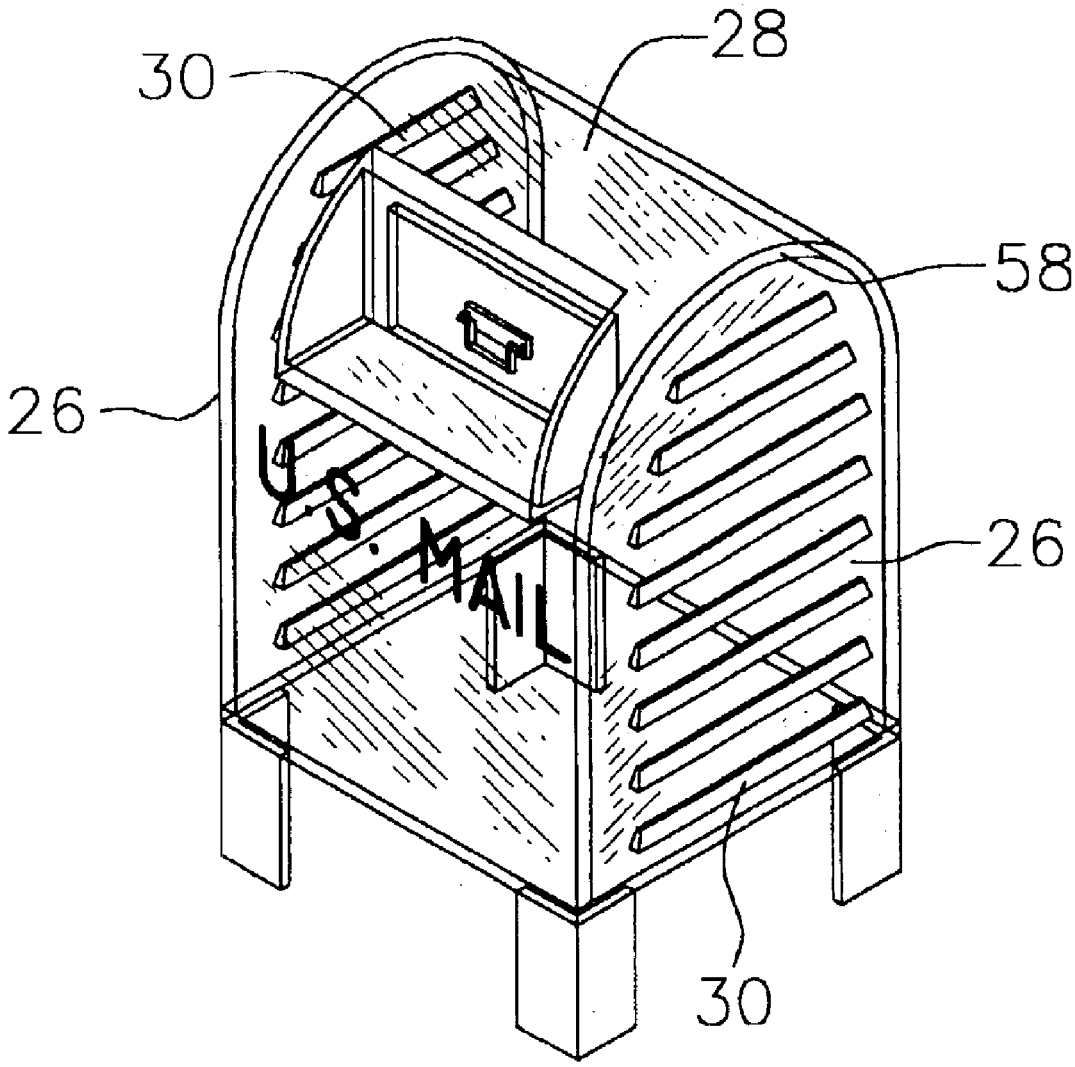
FIG. 7 is a schematic perspective view of a fourth embodiment of the present invention.

A fourth embodiment, depicted in FIG. 7, includes a device resembling a government mail collection box. The fourth embodiment has a body portion 14 including a bottom wall 20, a pair of side walls 26, a front wall 24, a back wall 22 and a top wall 28. Each of the side walls 26 has arcuate upper ends 58 such that the top wall 28 is arcuate. The door 18 is generally positioned at the juncture of the front wall 24 and the top wall 28. The louvers 30 of fourth embodiment are disposed in the side walls 26. The side walls 26, front wall 24, back wall 22, and top wall 28 of the fourth embodiment are substantially transparent.

In use, the louvers 30 allow air to flow through the housings 12 to remove contaminants such as biological germ agents from mail 6 positioned in the housing 12. The transparent walls of the body portion 14 allow UV radiation to enter the housing 12 to destroy germ agents and to allow the owner of the mailbox 10 to see what is located in the housing 12. The metal detector 32 and remote door opening features 34 allow a user to detect a bomb planted within mail and to open the mailbox 10 from a safe distance.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mailbox comprising:

a housing having a body portion having an opening therein, a door being attached to said body portion for selectively opening or closing said opening in said housing, said body portion having a plurality of louvers extending therethrough such that air may freely enter and leave said housing, said body portion including a bottom wall, a back wall, a pair of side walls and a top wall, said door defining a front wall of said housing, said louvers being disposed in said back wall and said door.

2. The mailbox of claim 1, wherein said body of said housing is substantially transparent.

3. The mailbox of claim 1, wherein each of said pair of side walls and said top wall are substantially transparent.

4. The mailbox of claim 3, further including a metal detecting assembly being mounted on said housing and being adapted for detecting metal positioned in said housing.

5. The mailbox of claim 4, further including a remotely controlled door opening assembly being mounted in said housing, said door opening assembly being selectively actuated by remote control.

6. The mailbox of claim 3, further including a remotely controlled door opening assembly being mounted in said housing, said door opening assembly being selectively actuated by remote control.

7. The mailbox of claim 1, further including a metal detecting assembly being mounted on said housing and being adapted for detecting metal positioned in said housing.

8. The mailbox of claim 1, further including a remotely controlled door opening assembly being mounted in said housing, said door opening assembly being selectively actuated by remote control.

9. A mailbox comprising:

a housing having a body portion having an opening therein, a door being attached to said body portion for selectively opening or closing said opening in said housing, said body portion including a bottom wall, a back wall, a front wall, a pair of side walls and a top wall, each of said pair of side walls and said top wall being substantially transparent, each of said door and said back wall having a plurality louvers extending therethrough such that air may freely enter and leave said housing;

a metal detecting assembly being mounted on said housing and being adapted for detecting metal positioned in said housing; and a remotely controlled door opening assembly being mounted in said housing, said door opening assembly being selectively actuated by remote control.

* * * * *